US007854838B2

(12) United States Patent
Martin

(10) Patent No.: US 7,854,838 B2
(45) Date of Patent: Dec. 21, 2010

(54) DEBRIS CAGE

(76) Inventor: Timothy Martin, P.O. Box 4386, Winchester, VA (US) 22604

( * ) Notice: Subject to any disclaimer, the term of this patent is extended or adjusted under 35 U.S.C. 154(b) by 71 days.

(21) Appl. No.: 12/230,652

(22) Filed: Sep. 3, 2008

(65) Prior Publication Data

US 2010/0025312 A1 Feb. 4, 2010

Related U.S. Application Data

(60) Provisional application No. 61/129,949, filed on Aug. 1, 2008.

(51) Int. Cl.
*E03F 5/06* (2006.01)

(52) U.S. Cl. ..... 210/163; 210/170.03; 210/232; 210/461; 210/474; 52/302.1

(58) Field of Classification Search ..... 210/163, 210/164, 170.03, 232, 459, 461, 474; 52/302.1
See application file for complete search history.

(56) References Cited

U.S. PATENT DOCUMENTS 1,434,254 A * 10/1922 Sanders ..... 210/163
1,791,512 A * 2/1931 Schurman ..... 210/163
1,862,134 A * 6/1932 Boosey ..... 210/163
1,973,321 A * 9/1934 Schultz ..... 210/163
2,079,269 A * 5/1937 Williams ..... 210/163
3,392,844 A * 7/1968 Decarie ..... 210/463
3,517,813 A * 6/1970 Thaler ..... 210/166
3,529,723 A * 9/1970 Hagedorn ..... 210/163
5,526,613 A * 6/1996 Simeone, Jr. ..... 210/163
6,141,916 A * 11/2000 Shackelford ..... 210/163
6,416,674 B1 * 7/2002 Singleton et al. ..... 210/163
6,537,448 B2 * 3/2003 Houk ..... 210/164
6,588,029 B2 * 7/2003 Mullings ..... 4/507

* cited by examiner

*Primary Examiner*—Christopher Upton
(74) *Attorney, Agent, or Firm*—Maier & Maier, PLLC

(57) ABSTRACT

A debris cage is disclosed. The debris cage may include multiple panels, each having a plurality of opening. Each of the panels may be fastened together to form an enclosed structure having a substantially cylindrical portion integral with a conical or dome-like portion at a terminating end of the enclosed structure. Each of the panels may have various shaped openings facilitating the flow of fluid while potentially impeding debris from passing through the debris cage.

7 Claims, 4 Drawing Sheets

DEBRIS CAGE

PRIORITY

This application claims priority, under 35 U.S.C. 119(e), to U.S. Provisional Patent Application No. 61/129,949, filed Aug. 1, 2008, which is hereby incorporated by reference in its entirety.

BACKGROUND

An outlet protection apparatus is often used in an attempt to prevent debris from clogging the exposed end of a drainage or irrigation pipe, and for simultaneously facilitating the free flow of fluid out of or into the pipe.

Large-diameter piping is often used to direct the flow of rainwater under land and away from areas that may be sensitive to oversaturation by water such as agricultural fields. Typically such piping is buried underground and terminates in one open end which directs water flow into a drainage ditch, reservoir, or natural stream.

During storms, intense weather activity or by simple happenstance, large debris may be washed into the piping and may become jammed in the pipe, blocking the piping, backing up water and thereby creating a surplus of unwanted water at the other end of the pipe. In addition, rain, runoff and wind also tend to wash or blow dirt and debris into the open ends of the drop inlets, which may then collect in collection boxes and sewer pipes.

It often becomes necessary to clear these drainage pipes, drop inlets and collection boxes which often means manually cleaning out the dirt and/or debris that has been washed or accidentally dropped into the drainage pipes. Such cleaning operations are difficult as the pipes are somewhat cramped, making it difficult to maneuver, and there is also the danger of cave-ins or collapse of the dirt, etc. that has built up around the sides of the drop inlets, creating a significant risk of injury. In addition, there can be deep drop-offs from the surface and the upper end of the drop inlet, to the bottom of the pipe. A fall from such a height can cause severe injuries to persons who might inadvertently fall into the inlet, especially as the open end of the inlet becomes obscured by dirt and other debris. The danger of an exposed pipe may be especially great for children who might play around the area and are more likely to be curious and to inadvertently fall in and become trapped within the drainage pipes.

In the past, the open upper ends of the pipe inlets generally have been protected with a fence structure constructed of a flexible mesh or screen material attached to a series of wooden stakes positioned about the open upper end of the drop inlet. Such arrangements often fail to prevent debris from falling into the open end of the pipe, and they provide little or no protection against persons inadvertently falling into an open drop inlet, and especially for keeping children out of the inlet.

Other devices have also been developed that allow water and debris to flow out of a drain. For example, a drain tile and pipe protector for a pipe having a generally an end fitted with a downwardly angled filter grate which is drilled with a plurality of small holes. The grate is mounted to a hinge pin enabling the grate to be selectively raised or lowered.

Thus, the prior art appears deficient in providing a robust drainage or irrigation pipe protection device which simultaneously prevents debris from entering the pipe, and yet simultaneously permits fluid flow through and out the device without clogging it.

SUMMARY

In at least one embodiment, a debris cage is disclosed. The debris cage may include multiple panels, each having a plurality of openings. Each of the panels may be fastened together to form an enclosed structure having a substantially cylindrical portion integral with a conical or dome-like portion at a terminating end of the enclosed structure. Each of the panels may have various shaped openings facilitating the flow of fluid while potentially impeding debris from passing through the debris cage.

In another embodiment, a debris cage may include multiple panels, each having a plurality of openings. Each of the panels may be fastened together to form an enclosed structure having a substantially cylindrical portion integral with a conical or dome-like portion at a terminating end of the enclosed structure. Each of the openings on the cylindrical portion of the debris cage may be substantially the same size and shape.

BRIEF DESCRIPTION OF THE FIGURES

Advantages of embodiments of the debris cage will be apparent from the following detailed description of the exemplary embodiments thereof, which description should be considered in conjunction with the accompanying drawings in which.

DETAILED DESCRIPTION

Aspects of the debris cage are disclosed in the following description and related drawings directed to specific embodiments of the debris cage. Alternate embodiments may be devised without departing from the spirit or the scope of the debris cage. Additionally, well-known elements of exemplary embodiments of the debris cage will not be described in detail or will be omitted so as not to obscure the relevant details of the debris cage. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the debris cage" or "embodiments" do not require that all embodiments of the debris cage system include the discussed feature, advantage or mode of operation.

Figure 1:
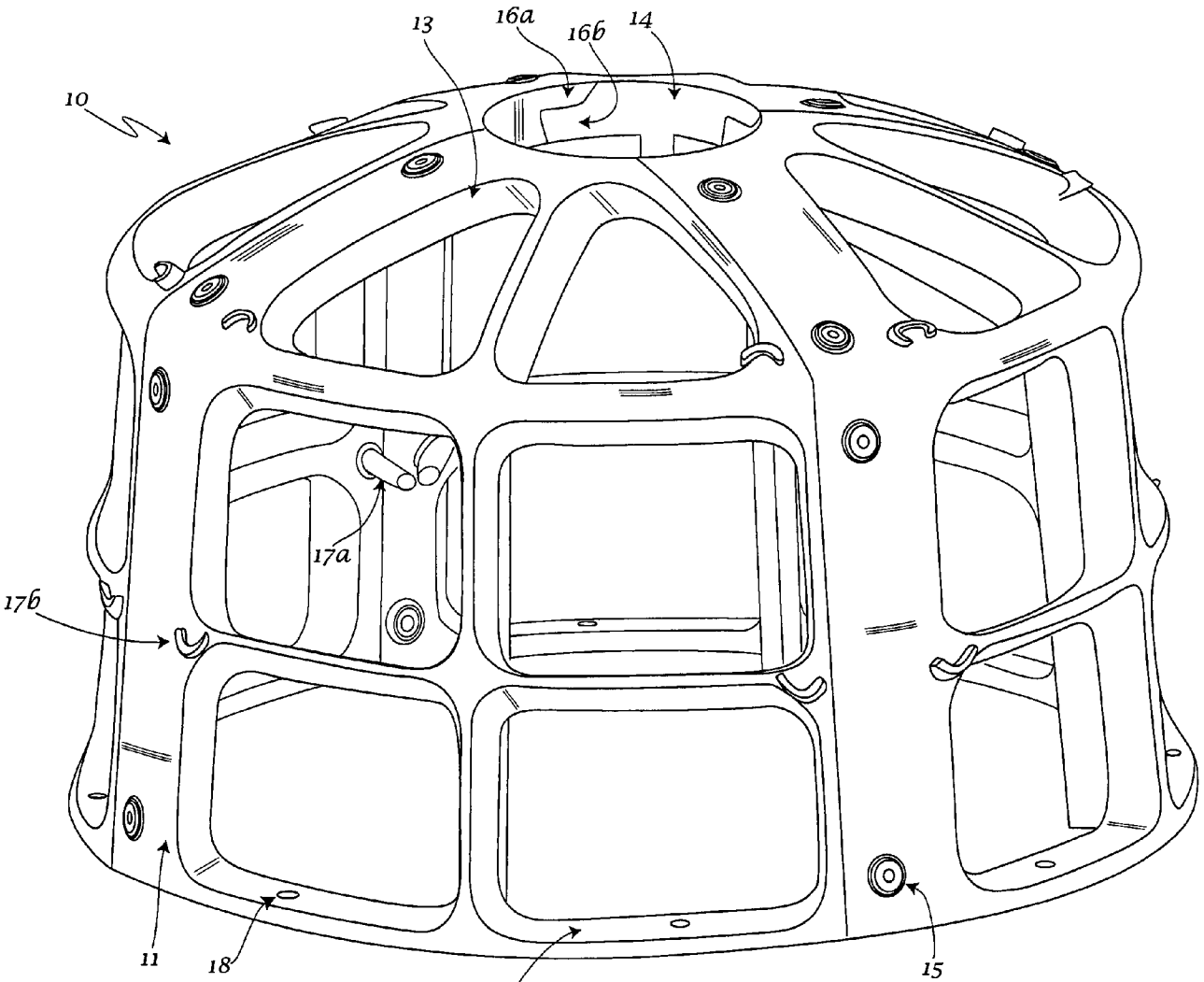
FIG. 1 is a perspective view of a first exemplary embodiment of a debris cage.
Figure 2:
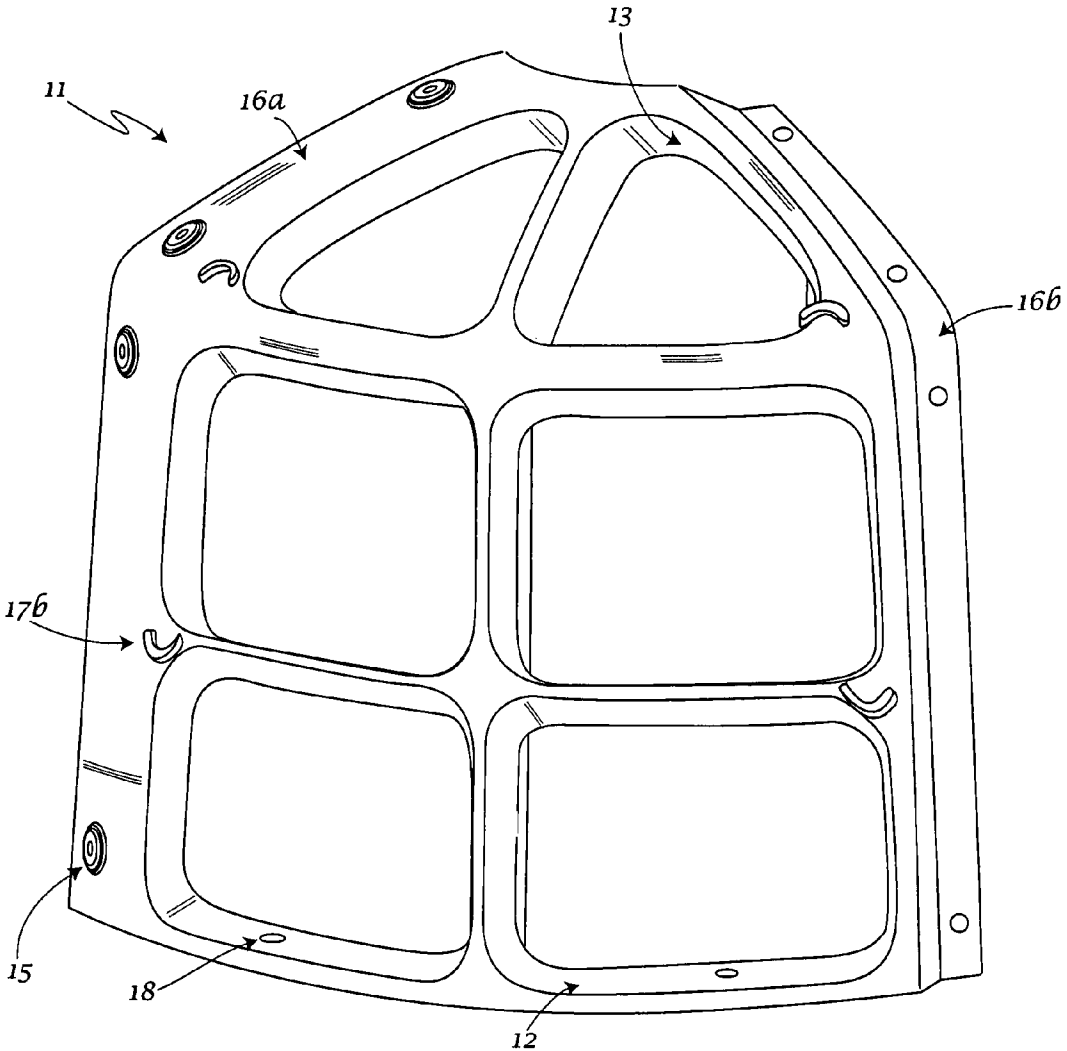
FIG. 2 is a front view of an exemplary panel of a first exemplary embodiment of a debris cage.

As generally shown in FIGS. 1 and 2, a first exemplary embodiment of a debris cage 10 may include multiple adjoining panels 11 which may form a substantially cylindrical cage with a substantially conical or dome-like terminal end. The debris cage 10 may also be formed in different desired shapes and sizes, for example, with a rectangular, triangular or square cross-sectional area or any other desired shape of the cross-sectional area. Additionally, the debris cage 10 may include alternate shapes for the terminal end which may include pyramid-type shapes or any other shapes that may have a decreasing cross-sectional area.

In an exemplary embodiment, the debris cage may include multiple panels 11 which may be adjoined or fastened together to form an enclosed area. The number of panels 11 necessary to form a complete enclosure may vary and may include as few as one panel (a single unitary enclosure) and as many as desired by one skilled in the art. In the first exemplary embodiment, shown in FIG. 1, four symmetrical panels 11 are fastened together to form the debris cage 10. These panels may be symmetrical or they may vary in shape, one from the other.

The first exemplary embodiment, as shown in FIGS. 1 and 2, may include panels 11 with various openings 12 and 13. These openings 12 and 13 are designed to facilitate the free flow of fluid through the panels 11 and debris cage 10, while potentially inhibiting debris from passing through the debris cage 10. The openings 12 and 13 may be formed of various sizes and shapes, for example, triangular, rectangular or any other desired shape. Additionally, some of the openings 12 may have similar or substantially the same shape as adjacent openings 12. However, openings 12 may also have a different shape than openings 13 which may lie closer to the terminating end of each panel 11. Adjacent openings 13 may also have similar or substantially the same shape, be symmetrical or have different shapes.

As shown in FIGS. 1 and 2, openings 12 and 13 may be formed in linear rows and columns, or alternatively, in any other desired configuration. In an exemplary embodiment, rectangular openings 12 may be formed on a substantially cylindrical portion of the debris cage 10, whereas, triangular openings 13 may be formed on a conical portion of the debris cage 10. Additionally, each panel may have a convex or semi-circle portion at a terminating end, which when fastened together with the other panels 11 may form a circular opening 14 at a terminating end of the debris cage 10. The general shape of opening 14 may vary in any desired size and shape.

In other exemplary embodiments, openings 12, 13 and 14 may vary in width and height depending on the overall desired size of the debris cage 10. For example, openings 12, 13 and 14 may be between 4 and 6 inches in height and width, between 6 and 12 inches in width and height or any other desired width and height. The width of material between each opening may also vary depending on the overall size of the debris cage 10. For example, the width of material between each opening may be ⅝ of an inch wide or any other desired width. Additionally, the thickness of the panels 11 may be 1½ inches thick or any other desired thickness.

In the first exemplary embodiment, panel 11 may include a flange 16*a* which may overlap with an opposite flange 16*b* of an adjacent panel 11. Each panel 11 may be fastened to an adjacent panel by rivets 15, screws, nails or any other desired fastening mechanism. Adjacent panels 11 may also be fastened by an adhesive, welding or any other fastening method or device know to one skilled in the art.

In an exemplary embodiment a debris cage 10 may be affixed to or enclose drain pipes, manholes or any other openings that may require the flow of fluid while having the need to impede debris from entering or exiting the opening. Debris cage 10 may be fastened to a drain pipe or opening by attaching the two elements through driving screws, nails, rivets or other fastening mechanisms through holes 18. Fastening the debris cage 10 to an opening through holes 18, may increase the stability of the debris cage when used alone or in conjunction with other desired fastening devices or methods.

In another exemplary embodiment, debris cage 10 may include shipping pegs 17*a* with corresponding receiving rims 17*b*. Debris cage 10 can be shipped in varying multiples and, therefore, may be stacked one on top of the other in a nested fashion. This nested stacking can reduce the size of the packaging necessary to ship the debris cages 10 while also potentially increasing the ability to organize groups of debris cages 10.

When the multiple debris cages are stacked together, shipping pegs 17*a*, which may lie on the inner surface of each panel 11, can rest on corresponding receiving rims 17*b*, which may lie on the outer surface of each panel, of a previously stacked debris cage 10. The shipping pegs 17*a* and receiving rims 17*b* may also lie on alternating surfaces of the panels 11, for example, shipping pegs 17*a* may lie on the outer surface of the panels 11 and the receiving rims may lie on the inner surface of the panels 11. The mating of the shipping pegs 17*a* and receiving rims 17*b* may provide additional stability and protection for the debris cages 10 during shipment.

Figure 3:
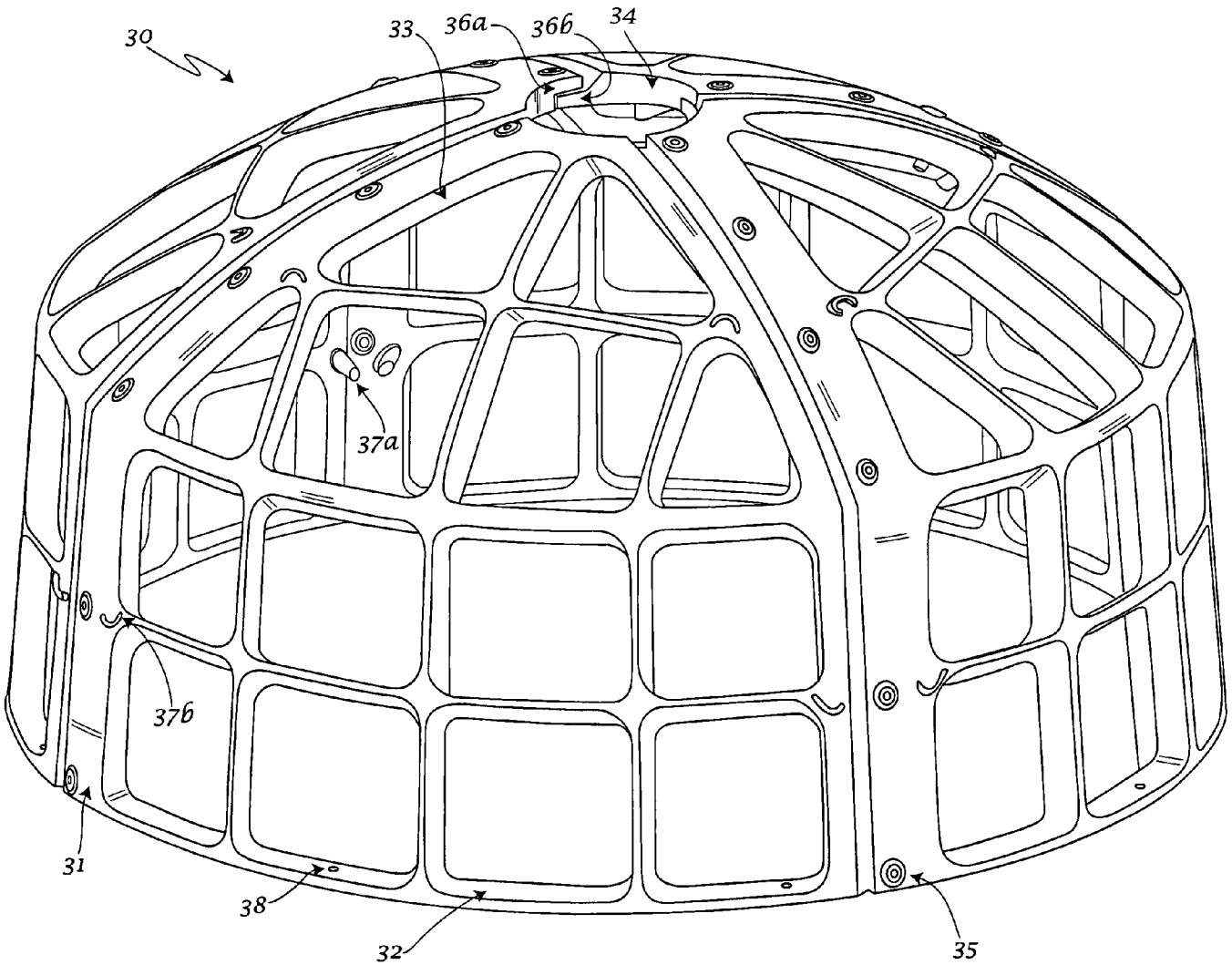
FIG. 3 is a perspective view of a second exemplary embodiment of a debris cage.
Figure 4:
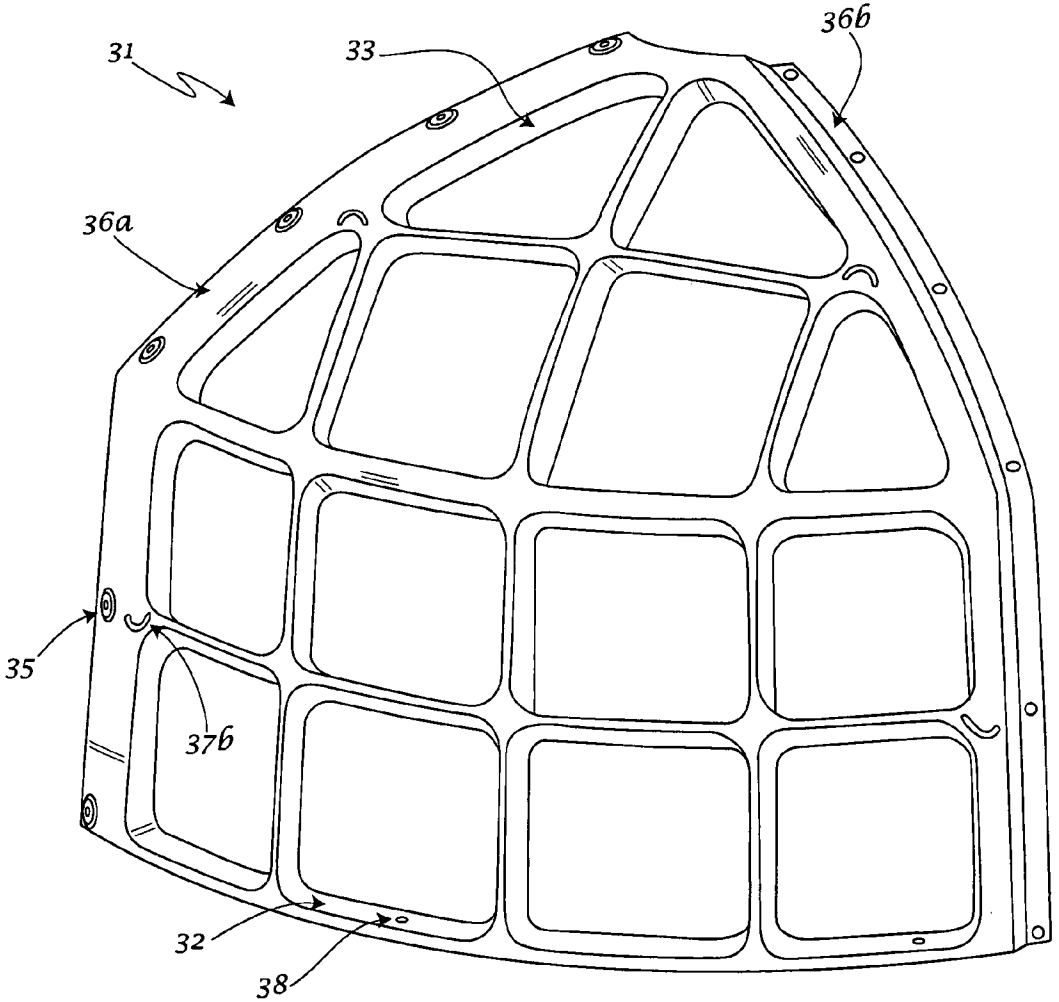
FIG. 4 is a front view of an exemplary panel of a second exemplary embodiment of a debris cage.

As generally shown in FIGS. 3 and 4, a second exemplary embodiment of a debris cage 30 may include multiple adjoining panels 31 which may form a substantially cylindrical cage with a substantially conical or dome-like terminal end. The debris cage 30 may also be formed in a different desired shapes and sizes, for example, with a rectangular, triangular or square cross-sectional area or any other desired shape of the cross-sectional area. Additionally, the debris cage 30 may include alternate shapes for the terminal end which may include pyramid-type shapes or any other shapes that may have a decreasing cross-sectional area.

In an exemplary embodiment, the debris cage 30 may include multiple panels 31 which may be adjoined or fastened together to form an enclosed area. The number of panels 31 necessary to form a complete enclosure may vary and may include as few as one panel (a single unitary enclosure) and as many as desired by one skilled in the art. In the second exemplary embodiment, shown in FIG. 3, four symmetrical panels 31 are fastened together to form the debris cage 30. These panels may be symmetrical or they may vary in shape, one from the other.

The second exemplary embodiment, as shown in FIGS. 3 and 4, may include panels 31 with various openings 32 and 33. These openings 32 and 33 are designed to facilitate the free flow of fluid through the panels 31 and debris cage 30, while potentially inhibiting debris from passing through the debris cage 30. The openings 32 and 33 may be formed of various sizes and shapes, for example, triangular, rectangular or any other desired shape. Additionally, some of the openings 32 may have similar or substantially the same shape as adjacent openings 32. However, openings 32 may also have a different shape than openings 33 which may lie closer to the terminating end of each panel 31. Adjacent openings 33 may also have similar or substantially the same shape, be symmetrical or have alternating or different shapes, as shown in FIGS. 3 and 4.

As shown in FIGS. 3 and 4, openings 32 and 33 may be formed in linear rows and columns or in any other desired configuration. In an exemplary embodiment, rectangular openings 32 may be formed on a substantially cylindrical portion of the debris cage 30, whereas, both rectangular and triangular openings 33 may be formed on a conical portion of the debris cage 30. Additionally, each panel may have a convex or semi-circle portion at a terminating end, which when fastened together with the other panels 31 may form a circular opening 34 at a terminating end of the debris cage 30. The general shape of opening 34 may vary in any desired size and shape.

In other exemplary embodiments, openings 32, 33 and 34 may vary in width and height depending on the overall desired size of the debris cage 30. For example, openings 32, 33 and 34 may be between 4 and 6 inches in height and width, between 6 and 12 inches in width and height or any other desired width and height. The width of material between each opening may also vary depending on the overall size of the debris cage 30. For example, the width of material between each opening may be ⅝ of an inch wide or any other desired width. Additionally, the thickness of the panels 11 may be 1½ inches thick or any other desired thickness.

In the second exemplary embodiment panel 31 may include a flange 36*a* which may overlap with an opposite flange 36*b* of an adjacent panel 31. Each panel 31 may be fastened to an adjacent panel 31 by rivets 35, screws, nails or any other desired fastening mechanism. Adjacent panels 31 may also be fastened by an adhesive, welding or any other fastening method or device know to one skilled in the art.

In another exemplary embodiment, debris cage 30 may include shipping pegs 37*a* with corresponding receiving rims 37*b*. Debris cage 30 can be shipped in varying multiples and, therefore, may be stacked one on top of the other in a nested fashion. This nested stacking can reduce the size of the packaging necessary to ship the debris cages 30 while also potentially increasing the ability to organize groups of debris cages 30.

When the multiple debris cages are stacked together, shipping pegs 37*a*, which may lie on the inner surface of each panel 31, can rest on corresponding receiving rims 37*b*, which may lie on the outer surface of each panel, of a previously stacked debris cage 30. The shipping pegs 37*a* and receiving rims 37*b* may also lie on alternating surfaces of the panels 31, for example, shipping pegs 37*a* may lie on the outer surface of the panels 31 and the receiving rims may lie on the inner surface of the panels 31. The mating of the shipping pegs 37*a* and receiving rims 37*b* may provide additional stability and protection for the debris cages 30 during shipment.

In an exemplary embodiment a debris cage 30 may be affixed to or enclose drain pipes, manholes or any other openings that may require the flow of fluid while having the need to impede debris from entering or exiting the opening. Debris cage 30 may be fastened to a drain pipe or opening by attaching the two elements through driving screws, nails, rivets or other fastening mechanisms through holes 38. Fastening the debris cage 30 to an opening through holes 38, may increase the stability of the debris cage when used alone or in conjunction with other desired fastening devices or methods.

In another exemplary embodiment debris cages 10 and 30 may be made of structural plastic having a cellular core which may be surrounded by integral plastic skins forming a total integrated structure. These debris cages 10 and 30 may be made from High Density Polyethylene (H.D.P.E.) which has a high strength-to-weight ratio and may have greater rigidity than solid parts of the same material of equal weight. Using this structural plastic for the debris cages may facilitate lower weight, a decrease in corrosion, an increase in chemical resistance and greater stability. Debris cages 10 and 30 may also be made of metal, wood, concrete or any other substantially rigid material know to one skilled in the art.

Virgin material may also be used to increase the likelihood that expected mechanical properties are maintained throughout the life of the debris cage 10 and 30. Glass fill may be added within the structural plastic to add rigidity and may aid in attaining approximate deflection values of: load rating: 2030 lbs./sq. ft, ultimate yield strength: 1855 lbs./sq. ft., maximum deflection (@90 degrees F.): >2.00 inches or alternative deflection values varying with the desired material used and method of manufacture.

The foregoing description and accompanying drawings illustrate the principles, preferred embodiments and modes of operation of the debris cage. However, the debris cage should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the debris cage as defined by the following claims.

What is claimed is:

1. A debris cage comprising:

an enclosure formed by a plurality of symmetrical panels removably fastened together, each panel including portions such that when assembled, said enclosure comprises:

a substantially cylindrical portion, wherein the cylindrical portion includes a plurality of openings; and a substantially dome-like portion above the cylindrical portion, wherein the substantially dome-like portion includes a plurality of openings.

2. The debris cage of claim 1, wherein the panels include flanges on opposite sides of each panel which overlap with adjacent panels to form the enclosure.

3. The debris cage of claim 1, wherein at least one of the plurality of openings of the substantially cylindrical portion is rectangular.

4. The debris cage of claim 1, wherein at least one of the plurality of openings of the substantially dome-like portion is triangular.

5. The debris cage of claim 1, wherein the dome-like portion includes an apex having an opening at a center location.

6. The debris cage of claim 1, wherein the enclosure also includes a plurality of pegs extending from an interior surface of the enclosure into an interior portion of the enclosure.

7. The debris cage of claim 6, wherein the enclosure also includes a plurality of rims extending from an exterior surface of the enclosure corresponding to the location of the pegs.

* * * * *